US008360070B2

(12) United States Patent
Zhao

(10) Patent No.: US 8,360,070 B2
(45) Date of Patent: Jan. 29, 2013

(54) PORTABLE WATER PIPE

(75) Inventor: Lubin Zhao, Guangdong (CN)

(73) Assignee: Guangzhou Zhaoying Hardware Co., Ltd. (CN)

( * ) Notice: Subject to any disclaimer, the term of this patent is extended or adjusted under 35 U.S.C. 154(b) by 0 days.

(21) Appl. No.: 12/808,182

(22) PCT Filed: Nov. 14, 2008

(86) PCT No.: PCT/CN2008/073052

§ 371 (c)(1),
(2), (4) Date: Jun. 15, 2010

(87) PCT Pub. No.: WO2010/031228

PCT Pub. Date: Mar. 25, 2010

(65) Prior Publication Data

US 2010/0263681 A1 Oct. 21, 2010

(30) Foreign Application Priority Data

Sep. 16, 2008 (CN) ..... 2008 2 0200509 U

(51) Int. Cl.
*A24F 1/14* (2006.01)

(52) U.S. Cl. ..... 131/173

(58) Field of Classification Search ..... 131/173
See application file for complete search history.

(56) References Cited

U.S. PATENT DOCUMENTS 7,404,405 B1 * 7/2008 Mehio ..... 131/173
2006/0207621 A1 * 9/2006 Shraiber ..... 131/348

FOREIGN PATENT DOCUMENTS

CN 2774181 * 4/2006

OTHER PUBLICATIONS

English Abstract of CN2774181, printed from Espacenet.com on Apr. 11, 2012.*

* cited by examiner

*Primary Examiner* — Richard Crispino
*Assistant Examiner* — Dionne Walls Mayes
(74) *Attorney, Agent, or Firm* — George G. Wang; Bei & Ocean

(57) ABSTRACT

The present invention discloses a portable water pipe, has a smoking pipe body and a smoking hose connected with the smoking pipe body. The smoking pipe body comprises a cover, a cut tobacco burning device and a water bottle. The cover is provided with air inlet holes, and an opening is provided in the top surface of the water bottle, and thus an enclosed space is formed by the cover and the water bottle. The cut tobacco burning device is provided in the enclosed space and is fixed at the opening of the water bottle by connecting elements. When in use, water is firstly filled in the water bottle, and then the cut tobacco placed in the cut tobacco burning device is lit and the cover is placed. A smoker begins smoking through the smoking hose. Smoke produced by the burning of the cut tobacco in the cut tobacco burning device is discharged through a smoke filtering tube and is then filtered through water and discharged through the smoking hose. The present utility model integrates the cut tobacco burning device in a bottle body formed by the cover and the water bottle, which has a compact structure, a small volume and good portability, and is convenient for the smoker to use during travel.

10 Claims, 2 Drawing Sheets

PORTABLE WATER PIPE

FILED OF THE INVENTION

The present invention relates to a smoking apparatus, in particular, to a water pipe.

BACKGROUND OF THE INVENTION

There is a wide variety of water pipes. For example, Chinese Patent CN2537239Y discloses a water pipe, which comprises a smoking pipe and a mouthpiece, a smoke channel is provided in the smoking pipe, a bowl holder is connected to the upper end of the smoking pipe, and a bowl is connected to the top of the bowl holder, a plurality of through holes are formed in the bottom of the bowl and are in communication with the smoke channel in the smoking pipe; a water container is connected to the lower end of the smoking pipe, and the smoke channel in the smoking pipe extends into the water container, a cavity is provided at the joint of the lower end of the smoking pipe and the water container; a smoke-hole joint is further provided on the lower end of the smoking pipe, and the smoke-hole joint is in communication with the cavity, and the mouthpiece is connected with the smoke-hole joint through a long hose. During use, cut tobacco is firstly placed in the bowl and is sealed by a tinfoil that is perforated to form a plurality of small holes, and then burning charcoal is placed on the tinfoil, and then a smoker may inhale tobacco smoke by sucking through the mouthpiece. The device is used on a negative pressure principle. Since smoke is produced by the cut tobacco between the tinfoil and the bowl, when a smoker sucks on the mouthpiece, a negative pressure is produced in the smoke channel, and the smoke enters the water container through the smoke channel from the bowl, and after being filtered through clean water, the smoke is drawn out of the mouthpiece from the cavity at the lower end of the smoking pipe through the smoke-hole joint and the hose. The water pipe has the characteristics of durability, convenience in use and an aesthetic appeal, and is thus well received by the vast water pipe smokers. However, said water pipe still has some deficiencies in the process of practical use, such as a) a large volume, which makes it difficult to take around for smoking and thus cannot meet the traveling need; b) relative complexity of its connecting parts and complicated assembling process, which directly results in high cost in both production and use; and c) a water container made of glass, which is susceptible to damage and affects the service life span of the device as a whole, etc.

SUMMARY OF THE INVENTION

The object of the present invention is to provide a portable water pipe, which is firm and durable, convenient to use and take around, and the industrial production of which is achievable. The present invention provides a portable water pipe, comprising a smoking pipe body and a smoking hose connected with the smoking pipe body. The smoking pipe body comprises a cover, a cut tobacco burning device and a water bottle. The cover is provided with air inlet holes, and an opening is provided in the top surface of the water bottle, and thus an enclosed space is formed by the cover and the water bottle. The cut tobacco burning device is provided in the enclosed space and is fixed at the opening of the water bottle by connecting elements. The cut tobacco burning device is connected to a smoke filtering tube which is provided in the water bottle. In use, water is firstly filled in the water bottle, and then the cut tobacco placed in the cut tobacco burning device is lit and the cover is placed. A smoker begins smoking through the smoking hose. Smoke produced by the burning of the cut tobacco in the cut tobacco burning device is discharged through the smoke filtering tube and is then filtered through water and discharged through the smoking hose; while the air needed for the burning of the cut tobacco enters through the air holes in the cover. The present invention integrates the cut tobacco burning device in a body formed by the cover and the water bottle, thus it has a compact structure, considerably reducing the bulkiness and giving rise to a good portability, which makes it a lot more convenient for a smoker to use during travel and has overcome the limit of the traditional products which can only be used indoors.

As an embodiment of the present invention, the cut tobacco burning device comprises a bowl, a bowl cover disc and a bowl hood. A plurality of small through holes are provided in the bottom of the bowl, and the bowl cover disc is placed on the bowl, and a plurality of small through holes are provided in the bowl cover disc, the bowl hood is covered on the bowl and the bowl cover disc, and a plurality of air inlet holes are provided in the outer wall of the bowl hood. In use, cut tobacco is placed in the bowl, and the bowl cover disc is placed, and then burning charcoal is placed on the bowl cover disc and the bowl hood is placed. The hot air of the charcoal enters the bowl through the small through holes in the bowl cover disc to ignite the cut tobacco, while the air needed for the combustion of the charcoal enters through the small air inlet holes in the bowl hood, smoke produced by the burning of the cut tobacco enters the smoke filtering tube through the small through holes in the bottom of the bowl. The cut tobacco burning device of such a structure in combination with the use of the cover can also prevent a large amount of hot air produced in the process of the combustion of the charcoal during use of the water pipe from scalding the smoker, and thus ensures a safe use.

As a further perfection of the present invention, the bowl and the bowl hood are connected into one by a lock fastener. The use of the lock fastener can prevent spillage of cut tobacco in the bowl and that of the charcoal on the bowl cover disc.

As an embodiment of the present invention, the connecting elements of the cut tobacco burning device and the water bottle include a connecting male bush and an opening female bush, the lower end of the bowl and the upper end of the smoke filtering tube are engaged on the connecting male bush, the opening female bush is provided on the opening of the water bottle, and the connecting male bush and the opening female bush are connected to cooperatively fix the cut tobacco burning device on the water bottle. Such a structure makes the connection between the cut tobacco burning device and the water bottle firm and easy, which not only simplifies the assembling process in the production of the product, but also makes the refill of water more convenient.

As a further perfection of the present invention, a larger O-shaped sealing ring, a smaller O-shaped sealing ring and a seal ring are provided at the joint of the connecting male bush, the opening female bush and the smoke filtering tube, wherein the larger O-shaped sealing ring is provided at the joint of the connecting male bush and the opening female bush, and the smaller O-shaped sealing ring and the seal ring are provided at the joint of the connecting male bush and the smoke filtering tube. Said measures are all taken to prevent leakage of water and smoke from the water bottle.

As a further perfection of the present invention, an air discharge device is provided on the upper part of the water bottle, wherein the air discharge device consists of an air discharge cap screw, a steel ball and an air discharge cap, and the air discharge cap screw is provided on the water bottle, the steel ball is placed on the air discharge cap screw, and the air discharge cap covers on the air discharge cap screw. When the concentration of the smoke in the water bottle is too high, a blow to the smoking hose will blow the extra smoke out of the air discharge device to achieve an appropriate smoke concentration.

As a further perfection of the present invention, a through hole which is in communication with the smoking hose is provided in a side wall of the water bottle, and a stopper is provided for said through hole. When not in use, the stopper is used to plug up the through hole after the smoking hose is pulled out of the through hole to prevent the water from flowing out of the water bottle.

As a further perfection of the present invention, bottle D-rings are provided on both sides of the water bottle, and shoulder straps are attached to the bottle D-rings. The arrangement of the shoulder straps makes it more convenient to take the apparatus around.

As an embodiment of the present invention, the smoking hose consists of a tail end connector, a straw, a middle connector, a handle and a mouthpiece, wherein the handle is connected to the straw through the middle connector, the straw is connected to the tail end connector and then to the through hole in the side wall of the water bottle, and the mouthpiece is connected to the handle.

As an embodiment of the present invention, the cover and the water bottle of the smoking pipe body are made of stainless steel. The employment of stainless steel may make the product insusceptible to damage and prolong its service time.

In summary, the water pipe of the present invention has the characteristics of good portability, firmness and durability, and the industrial production thereof is realizable, which can sufficiently meet the needs of the water pipe manufacturers and smokers.

The present invention is further explained with reference to the accompanying drawings and embodiments.

DETAILED DESCRIPTION OF PARTICULAR EMBODIMENTS OF THE INVENTION

Figure 1:
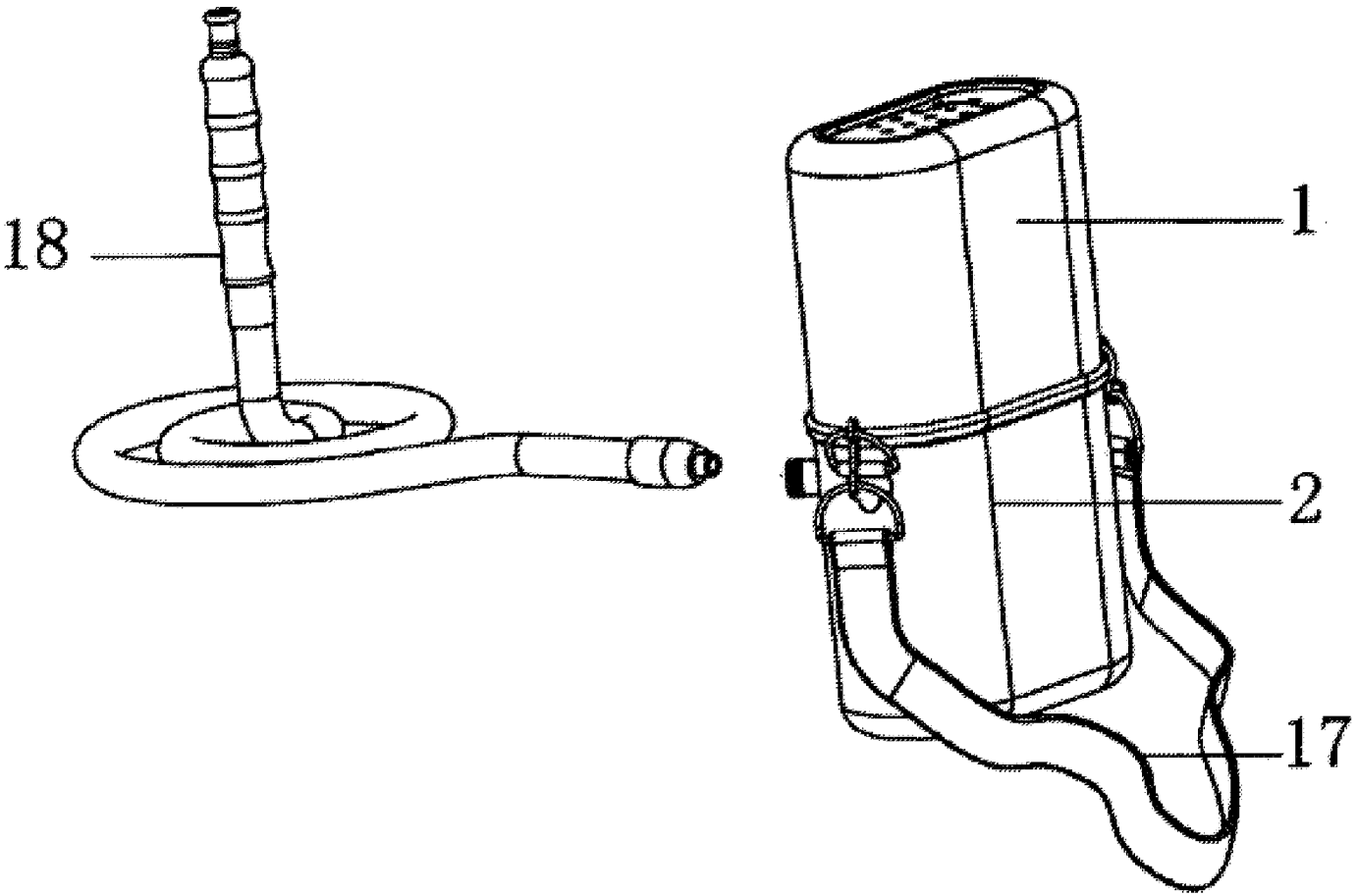
FIG. 1 is an overall structure of a portable water pipe according to the present invention.
Figure 2:
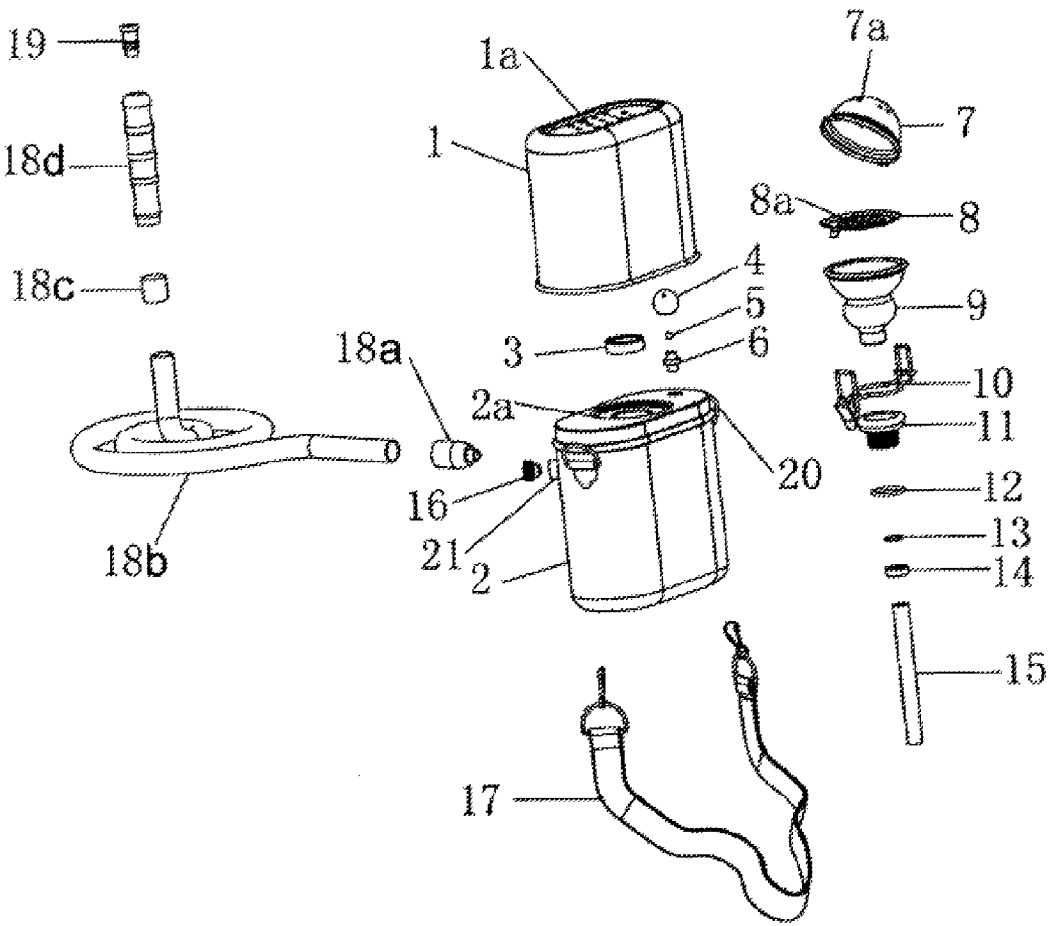
FIG. 2 is a schematic view of the assembling of the portable water pipe according to the present invention.

As shown in FIGS. 1 and 2, the portable water pipe of the present invention is formed by a smoking pipe body and a smoking hose 18 connected with the smoking pipe body. The smoking pipe body comprises a cover 1, a cut tobacco burning device and a water bottle 2. The cover 1 is provided with air inlet holes 1*a*, and an opening 2*a* is provided in the top surface of the water bottle 2, and thus an enclosed space is formed by the cover 1 and the water bottle 2. The cut tobacco burning device is provided in the enclosed space and is fixed at the opening 2*a* of the water bottle 2 by connecting elements. The cut tobacco burning device is connected to a smoke filtering tube 15 which is provided in the water bottle 2. When in use, water is firstly filled in the water bottle 2, and then the cut tobacco placed in the cut tobacco burning device is lit and the cover 1 is placed. A smoker begins smoking through the smoking hose 18. Smoke produced by the burning of the cut tobacco in the cut tobacco burning device is discharged through the smoke filtering tube 15 and is then filtered through water and discharged through the smoking hose 18; while the air needed for the burning of the cut tobacco enters through the air holes 1*a* in the cover 1.

The cut tobacco burning device of the present invention comprises a bowl 9, a bowl cover disc 8 and a bowl hood 7. A plurality of small through holes are provided in the bottom of the bowl 9, and the bowl cover disc 8 is placed on the bowl 9, and a plurality of small through holes 8*a* are provided in the bowl cover disc 8, the bowl hood 7 is covered on the bowl 9 and the bowl cover disc 8, and a plurality of small air inlet holes 7*a* are provided in the outer wall of the bowl hood 7. The bowl 9 and the bowl hood 7 are connected into one by a lock fastener 10. During use, cut tobacco is placed in the bowl, the bowl cover disc is placed, and then burning charcoal is placed on the bowl cover disc and the bowl hood is placed. The hot air of the charcoal enters the bowl 9 through the small through holes 8*a* in the bowl cover disc 8 to ignite the cut tobacco, while the air needed for the combustion of the charcoal enters through the small air inlet holes 7*a* in the bowl hood 7, and smoke produced by the burning of the cut tobacco enters the smoke filtering tube 15 through the small through holes (not shown in FIG. 2) in the bottom of the bowl 9.

The connecting elements of the cut tobacco burning device and the water bottle 2 of the present utility model include a connecting male bush 11 and an opening female bush 3, the lower end of the bowl 9 and the upper end of the smoke filtering tube 15 are engaged on the connecting male bush 11, the opening female bush 3 is provided on the opening 2*a* of the water bottle 2, and the connecting male bush 11 and the opening female bush 3 are connected to cooperatively fix the cut tobacco burning device on the water bottle 2.

A larger O-shaped sealing ring 12, a smaller O-shaped sealing ring 13 and a seal ring 14 of the present invention are provided at the joint of the connecting male bush 11, the opening female bush 3 and the smoke filtering tube 15, wherein the larger O-shaped sealing ring 12 is provided at the joint of the connecting male bush 11 and the opening female bush 3, and the smaller O-shaped sealing ring 13 and the seal ring 14 are provided at the joint of the connecting male bush 11 and the smoke filtering tube 15.

An air discharge device is provided on the upper part of the water bottle 2 of the present utility model, wherein the air discharge device consists of an air discharge cap screw 6, a steel ball 5 and an air discharge cap 4, and the air discharge cap screw 6 is provided on the water bottle 2, the steel ball 5 is placed on the air discharge cap screw 6, and the air discharge cap 4 covers on the air discharge cap screw 6. When the concentration of the smoke in the water bottle 2 is too high, a blow to the smoking hose 18 will blow the extra smoke out of the air discharge device to achieve an appropriate smoke concentration.

A through hole 21 which is in communication with the smoking hose is provided in a side wall of the water bottle 2, and a stopper 16 is provided for said through hole 21. When not in use, the stopper 16 is used to plug up the through hole 21 after the smoking hose 18 is pulled out of the through hole 21 to prevent the water from flowing out of the water bottle 2. Bottle D-rings 20 are provided on both sides of the water bottle 2, and shoulder straps 17 are attached to the bottle D-rings 20.

The smoking hose 18 of the present invention consists of a tail end connector 18*a*, a straw 18*b*, a middle connector 18*c*, a handle 18*d* and a mouthpiece 19, wherein the handle 18*d* is connected to the straw 18*b* through the middle connector 18*c*, the straw 18*b* is connected to the tail end connector 18*a* and then to the through hole 21 in the side wall of the water bottle 2, and the mouthpiece 19 is connected to the handle 18*d*.

The cover 1 and the water bottle 2 of the smoking pipe body in the present invention are made of stainless steel, and the material of the bowl 9 is ceramic.

What is claimed is:

1. A portable water pipe, comprising a smoking pipe body and a smoking hose connected with the smoking pipe body, the smoking pipe body comprising (a) a cover having air inlet holes, (b) a water bottle having a top surface with an opening, (c) a smoke filtering tube positioned inside the water bottle, and (d) a cut tobacco burning device positioned within an enclosed space enclosed by the cover and the top surface of the water bottle, fixed at the opening of the top surface and connected to the smoke filtering tube.

2. The portable water pipe according to claim 1, wherein the cut tobacco burning device comprises a bowl with a bottom containing a plurality of small through holes, a bowl cover disc with a plurality of small through holes and being placed on the bowl and a bowl hood with a plurality of small air inlet holes and covering the bowl and the bowl cover disc.

3. The portable water pipe according to claim 2, wherein the bowl and the bowl hood are connected into one element by a lock fastener.

4. The portable water pipe according to claim 1, further comprising connecting elements connecting both the cut tobacco burning device and the water bottle and comprising a connecting male bush engaged with both a lower end of the bowl and an upper end of the smoke filtering tube, and an opening female bush sitting on the opening of the top surface of the water bottle, wherein the connecting male bush and the opening female bush are connected to cooperatively fix the cut tobacco-burning device on the top surface of the water bottle.

5. The portable water pipe according to claim 4, wherein a larger 0-shaped sealing ring (12), a smaller 0-shaped sealing ring (13) and a seal ring (14) are provided at the joint of the connecting male bush (11), the opening female bush (3) and the smoke filtering tube (15), and the larger 0-shaped sealing ring (12) is provided at the joint of the connecting male bush (11) and the opening female bush (3), and the smaller 0-shaped sealing ring (13) and the seal ring (14) are provided at the joint of the connecting male bush (11) and the smoke filtering tube (15).

6. The portable water pipe according to claim 1, wherein an air discharge device is provided on an upper part of the water bottle (2), and the air discharge device consists of an air discharge screw cap (6), a steel ball (5) and an air discharge cap (4), and the air discharge screw cap (6) is provided on the water bottle (2), the steel ball (5) is placed on the air discharge screw cap (6), and the air discharge cap (4) is covered on the air discharge screw cap (6).

7. The portable water pipe according to claim 1, wherein a through hole (21) which is in communication with the smoking hose is provided in a side wall of the water bottle (2), and a stopper (16) is provided for said through hole (21).

8. The portable water pipe according to claim 1, wherein bottle D-rings (20) are provided on both sides of the water bottle (2), and shoulder straps (17) are attached to the bottle D-rings (20).

9. The portable water pipe according to claim 1, wherein the smoking hose (18) consists of a tail end connector (18*a*), a straw (18*b*), a middle connector (18*c*), a handle (18*d*) and a mouthpiece (19), wherein the handle (18*d*) is connected to the straw (18*b*) through the middle connector (18*c*), the straw (18*b*) is connected to the tail end connector (18*a*) and then to the through hole (21) in the side wall of the water bottle (2), and the mouthpiece (19) is connected to the handle (18*d*).

10. The portable water pipe according to claim 1, wherein the cover (1) and the water bottle (2) of the smoking pipe body are made of stainless steel.

* * * * *